United States Patent [19]

Morishita

[11] 4,011,865

[45] Mar. 15, 1977

[54] DUST-PROOF PROTECTION MASK OF FACE COVERING TYPE

[76] Inventor: Mitsu Morishita, No. 698, Takemukai, Myohoji, Sumaku, Kobe, Japan

[22] Filed: Sept. 26, 1975

[21] Appl. No.: 617,121

[52] U.S. Cl. ..... 128/142.3; 128/142.7

[51] Int. Cl.[2] ..... A62B 7/12

[58] Field of Search ..... 128/142 R–142.7, 128/145 R, 141 R, 146 R, 146.2, 146.7, 203; 2/171.3, 8 R

[56] References Cited

UNITED STATES PATENTS

| | | | |
|---|---|---|---|
| 908,108 | 12/1908 | Knudsen | 128/142.7 |
| 1,567,868 | 12/1925 | Schroder | 128/203 |
| 1,917,961 | 7/1933 | Fee | 128/145 R |
| 2,332,662 | 10/1943 | Nathanson | 128/142.3 |
| 2,644,159 | 7/1953 | Jacobs | 2/8 R |
| 2,644,160 | 7/1953 | Jacobs | 2/8 R |
| 2,818,859 | 1/1958 | Peterson | 128/141 R |
| 3,657,740 | 4/1972 | Cialone | 128/142.7 |
| 3,935,861 | 2/1976 | Warncke | 128/142 R |

FOREIGN PATENTS OR APPLICATIONS

| | | | |
|---|---|---|---|
| 931,031 | 7/1955 | Germany | 128/142 R |
| 656,724 | 2/1938 | Germany | 128/142 R |
| 1,193,522 | 6/1970 | United Kingdom | 128/188 |

*Primary Examiner*—Robert W. Michell
*Assistant Examiner*—Henry J. Recla
*Attorney, Agent, or Firm*—Frank J. Jordan

[57] ABSTRACT

A pair of small-sized air blowers or air blowing means, one being driven by means of an electric motor and the other being manually operated, are respectively connected to one end of two air inlet pipes each of which are selectively switched into operation by means of a three-way valve for providing flow and open feeding of air under pressure into a face covering type mask. An air inlet filter is mounted, as may be required, on the entrance side of the three-way valve. At least, one viewing window is provided on the front surface of the mask body. A transparent guard glass (and a colored, transparent light shielding glass for welding, as may be required) with suitable clearances for allowing the blowing-off of air therearound are oppositely fitted inside a viewing window. In addition, numerous small clearances are formed circumferentially between the inner side peripheral edge of the mask body and the face of a user to provide for air leak-off.

1 Claim, 5 Drawing Figures

DUST-PROOF PROTECTION MASK OF FACE COVERING TYPE

BACKGROUND OF THE INVENTION

The present invention relates to a dust-proof protection mask, and more particularly, to improvements in a face covering type dust-proof protection mask.

In order to prevent a mask user from inhaling various powdereddusts, and harmful, poisonous gases or mists from a sanitary point of view, the conventionally-used face covering type mask is adapted to breathe the air sucked through an air inlet passage or an air inlet pipe and to discharge the inhaled air, which contains a dioxide gas, outside from an exhaust port, no matter whether the air inlet filter is directly or remotely connected. Some limitations in air inlet and outlet quantity cannot be avoided, since air inlet and outlet resistances cannot be sufficiently reduced because, the mechanism includes an air inlet filter, an air inlet valve, an air outlet valve, etc. Accordingly, under the condition of intense operation, the user finds it difficult to breathe, and vapor in the exhaled air and due to sweating from the face are likely to dim or the impair view through the transparent guard glass, thus interfering with the user's visibility. Furthermore, the user finds it difficult to make conversation with the mask mounted on his face, particularly when the user wears it under the circumstances of higher temperatures and humidity for a comparatively long period of time, so-called eczema or heat rashes are likely to occur on the face due to close contact between the face contact portion of the trailing end peripheral edge of the mask body and the face. Many inconveniences, disadvantages, etc. have been experienced by users in the conventional face covering type mask. Summary of the Invention:

It is a general object of the present invention to provide a face covering type dust-proof and protection mask which is free from the disadvantages as described hereinabove and which can be applied in a wide range of uses.

It is a primary object of the present invention to provide a dustproof protection mask in which the user will find it easier and more comfortable to breathe even when working intensely, and in which the user will feel better when wearing the mask by reason of the fact that the air inlet and outlet resistances are smaller.

Another object of the present invention is to provide a dust-proof protection mask which ensures better ventilation inside the mask and better visibility at all times without dimming or impairing the view through the transparent protection glass, or goggles, or staining the glass through attachment of foreign materials on the glass.

Another object of the present invention is to provide a dustproof protection mask, in which the user will not find any difficulty and inconvenience in making conversations with the mask on his face.

A further object of the present invention is to provide a dustproof protection mask, in which even when the mask is worn for a long period of time under the circumstances of higher temperatures and humidity, the face portion which is in contact with the trailing end inner side peripheral edge of the mask is not "heated", thus preventing exzema and heat rashes.

These and other objects and the novel advantages of the present invention will become more apparent by reference to the following detailed description, taken in connection with the accompanying drawings. However, these drawings are intended to illustrate the invention and are not to be construed to limit the scope of the invention.

DETAILED DESCRIPTION OF THE INVENTION

Figure 1:
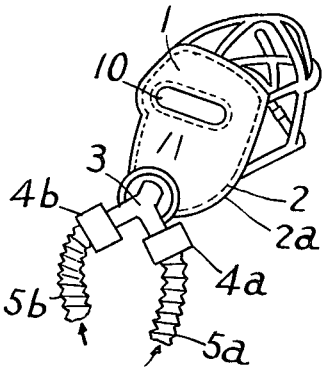
FIG. 1 is a schematic perspective view of a mask according to one embodiment of the invention.
Figure 2:
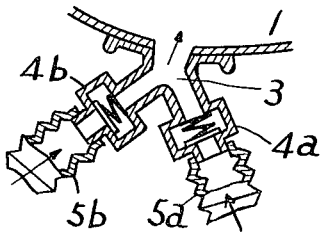
FIG. 2 is an enlarged cross-sectional view showing the air inlet opening in the body of the mask and the area adjacent to the air inlet opening.
Figure 3:
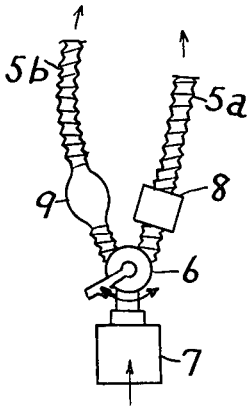
FIG. 3 is a partial front view showing a small-sized air blower directly connected to a battery-driven motor, a manually operated air blowing means such as an air supplying bulb for emergency use, a three-way valve, and an air inlet filter mounted on two air inlet pipes arranged in parallel.
Figure 4:
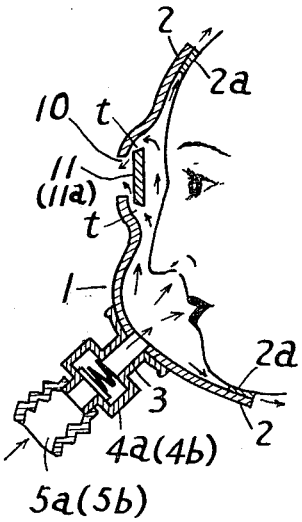
FIG. 4 is a cross-sectional view showing the mask body as worn by a user.

The embodiment of the present invention will be described hereinafter with reference to the accompanying drawings. Particularly, referring to FIG. 1 and FIG. 4, a relatively thick face contact portion edge piece 2*a*, which is made of a suitable flexible resilient material having, preferably, a proper degree of moisture absorptivity, evaporation releasability and ventilation properties, is mounted on the inner side of the trailing and peripheral edge 2 of a mask body 1 of the face covering type. The ribbonlike face contact portion edge piece 2*a* is provided, on its surfaces, with unevenness so that the air inside the mask, the pressure of which is slightly higher than that of air outside the mask, may be leaked positively as described hereinafter, through numerous fine clearance flow passages formed between the face and the face contact portion edge piece 2*a* which comes into partial and soft contact with the face of a user. As shown best in FIG. 2, an air inlet pipe connecting member 3, which is mounted on the mask body 1, is connected to corresponding air inlet pipes 5*a* and 5*b* through check valves 4*a* and 4*b* mounted respectively on the lower end forked portion of the air inlet pipe connecting member. The two flexible air inlet pipes are connected, at their respective lower ends, to the corresponding exit sides to a three-way valve 6 as shown in FIG. 3. An air inlet filter 7 is detachably fixed to the entrance side of the three-way valve, the inlet air filter 7 having suitable air filtering materials (not shown) charged therein, such as plastic-made sponge, activated carbon grains or carbon monoxide absorbents, etc. The first air inlet pipe 5*a*, which interconnects the check valve 4*a* with one exit of the three-way valve 6, has a small-size and light-weight air blower 8, attached thereto, which is directly connected to, for example, a battery-driven motor (not shown), while the second air inlet pipe 5*b*, which interconnects the check valve 4*b* and the other exit of the three-way valve 6 has, for example, a well-known conventional rubber-made air supplying bulb 9 attached thereon, which works as a spare manually-operated air blower.

A well-known hand or foot actuated air supplier, etc., instead of the air supplying bulb, may be used properly. At least one viewing window 10 is provided on the front surface of the mask body 1 and at least one transparent glass 11, which has the proper degree of clearances *t* therearound for allowing leaking out the air, is oppositely fitted and retained inside the viewing window. The open air is continuously fed into the mask through the air inlet pipe 5*a* or 5*b*, by switching of the three-way valve 6, normally by means of an electrically driven air blower 8, or by means of the manually-operated air blowing means arranged in parallel as a spare should the air blower 8 become inoperative, so that the inner pressure inside the mask body 1 may be retained slightly higher than the outer atmospheric pressure.

One portion of the air introduced forcibly into the mask body is used as aspiration, and the other portion thereof circulates through the mask and flows out, with the aspiration, through the air drawing-out clearances *t* around the guard glass 11 and through the numerous clearances formed circumferentially between the face contact portion edge piece 2*a* and the face of an user. Namely, there is an air flow, which is blown out of the clearances *t* along the outer surface of the protection glass 11, and which is discharged outside around the viewing window 10 to thereby shut off powdered-dust floating in the open air or harmful and poisonous gases, whereby entry into the mask of the powdered-dust or harmful gases is prevented without fail. Also, providing the proper degree of ventilation between the opposing faces almost completely removes any possibilities of developing so-called exzema or miliary-like exzema due to stimulations such as heating or oppression, etc. caused by putting the mask on the corresponding portion of the face. Compulsory introduction of a large amount of open air into the mask, through the functions of the electrically-driven air blower 8 or the suitable air blowing means 9, and the discharging operation of a large amount of air through the clearances *t* around the guard glass 11, the window 10 and the trailing end face contact portion of the mask body are adapted to fill the interior of the face covering type mask 1 with fresh air at all times, thus preventing the user from feeling choked even when he works harder. Accordingly, the protective mask has the advantage of ensuring an enlarged tolerance range of operation. Furthermore, a lot of air constantly circulates through the mask so that sufficient ventilation may be effected. Accordingly, increase in humidity inside the mask caused by sweating from the face and aspiration is effectively suppressed, the fitting feel of the mask is much improved, and the inconvenience of dimming or impaired viewing with vapor on both sides of the transparent guard glass 11 used as goggles is removed. Since the strong blowing-off stream of air in front of the guard glass effectively prevents fine paint particles or mist from attaching onto the guard glass through paint splashing caused during spray painting, clear visibility is assured at all times. Since the interior and exterior of the mask body 1 communicate with each other through the clearances *t* provided around the guard glass 11, and the viewing window 10 on the front side of the guard glass, the user can make himself understood freely with the mask on his face.

The air inlet filter 7 which is not required to be used with the air inlet pipe, which is connected to the entrance side of the three-way valve 6, may be opened simply and easily in a place, where fresh air is available, such as a place outside the work field. Even when it is essential for the mask to be used to purify the inspiration, the open air is introduced and fed, without fail, through the electrically driven air blower 8 or the suitable air blowing means 9. Accordingly, increase in inspiration resistance due to the fitted mask, in other words difficulties in breathing, are not encountered at all. The user can freely and easily breathe the fresh air purified through the filter, thus preventing lowering of working efficiency.

In the face covering type mask of the present invention, the open air is usually fed forcibly into the inside of the mask through the first air inlet pipe 5*a* by operation of the electrically driven air blower 8, whether the air inlet filter 7 is fitted or not. Should something go wrong with the air blower, the three-way valve 6 is switched to the second air inlet pipe and at the same time, the spare air supplying bulb or the other manually operated air blowing means 9 is operated. Thus, long hours of continuous service thereof is, if necessary, ensured without increasing aspiration resistance or reducing the performance of the mask.

Figure 5:
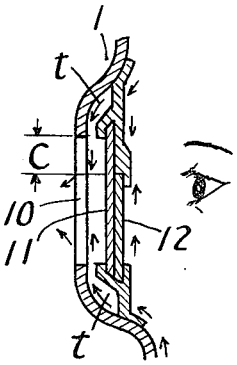
FIG. 5 is an enlarged cross-sectional view showing the respective positional relationship between at least one viewing window provided on the surface of the mask body, a transparent protection or guard glass provided facing the viewing window, and a colored light shielding glass which is fixed and retained as required.

Not only the harmful gases and powdered-dust, but also harmful ultraviolet and/or infrared rays are shut off to protect an arc welding or cutting operator by replacing the colorless and transparent guard glass 11, which is usually mounted on the mask body 1, with a piece of welding light shielding glass 11*a*. In such service conditions, however, a welding light shielding glass 12, such as shown in FIG. 5 and which is suitably smaller in vertical dimension than the colorless and transparent guard glass 11, is preferably fixed and retained inside the guard glass. The, the colorless and transparent guard glass 11 prevents so-called spatters, which are small molten-metal particles scattered during welding operation, from hitting against or attaching to the surface of the welding light shielding glass 12, and the welding operator with the mask fitted, as prescribed, on his face can perform proper positioning of a welding rod with respect to a weld line, assembling and tack welding of materials by means of a welding jig or welding positioner, and controlling operation of the welding positioner, etc. Since the welder can see the outside clearly through the portion of the guard glass facing the space C formed between the upper edge of the light shielding glass 12, — needless to say, it is necessary to set the position of the upper edge of the light shielding glass 12 somewhat above the level of the naked eyes to effectively shut off the harmful rays from the naked eyes of the mask user — and the upper edge of the viewing window opening 10. Furthermore, proper protective means should be taken simply by putting on a hat, etc. to prevent, as much as possible, the harmful rays of light incident through the space C from hitting the user on the face. Also, it is natural that the mask should be made of incombustibly-treated canvas, or preferably cloth woven of or intertwined with incombustible fibers such as glass fibers or glass fibers together with asbestos.

The invention has been described in its preferred form with a certain degree of particularity.

An many apparently widely different embodiments of this invention may be made without departing from the spirit and scope thereof, it is to be understood that the invention is not limited to the specific embodiments thereof except as defined in the appended claims.

What is claimed is:

1. A dust-proof protective mask comprising a mask body adapted to fit onto a wearer's face, said mask body having an air inlet opening, a first air inlet pipe connected to said air inlet opening, an electrically driven air blower on said first air inlet pipe for feeding air under pressure to said air inlet opening, an air filter on said first air inlet pipe, a second air inlet pipe connected to said first air inlet pipe, a manually-operated air blower means mounted on said second inlet pipe and operably mounted in parallel with said electrically driven air blower, said first and second air inlet pipes each having lower ends, a three-way valve to which said lower ends of said first and second air inlet pipes are connected for selectively switching flow of atmospheric air to said first or second air inlet pipes, said mask body having a peripheral edge, clearance means on said peripheral edge for leaking out air from between said clearance means and the user's face, said mask body having a viewing opening, a transparent viewing member, means mounting said transparent viewing member in said viewing opening to provide a clearance space between said transparent viewing member and said viewing opening for allowing air on the inside of the mask to blow out through said clearance space, a colored transparent welding light shielding member mounted on the inside of said transparent viewing member, said shielding member having a height less than the height of said transparent viewing member, said shielding member having an upper edge disposed above the level of the user's eyes, said shielding member being effective to shut off harmful rays of ultra-violet, infrared rays and the like from the user's eyes, said transparent viewing member having an upper portion extending above an upper edge of said shielding member and disposed between said upper edge of said shielding member and the upper edge of said viewing opening, whereby the wearer of the mask may freely see the outside through said upper portion of said transparent viewing member.

* * * * *